US008061552B2

(12) United States Patent
Hiner

(10) Patent No.: US 8,061,552 B2
(45) Date of Patent: Nov. 22, 2011

(54) STORAGE TANK WITH SELF-DRAINING FULL-CONTACT FLOATING ROOF

(75) Inventor: Larry Clifford Hiner, Naperville, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 1127 days.

(21) Appl. No.: 11/439,471

(22) Filed: May 23, 2006

(65) Prior Publication Data

US 2007/0272692 A1 Nov. 29, 2007

(51) Int. Cl.
*B65D 88/34* (2006.01)

(52) U.S. Cl. ..... 220/811; 220/216; 220/219

(58) Field of Classification Search ..... 220/216, 220/219, 811
See application file for complete search history.

(56) References Cited

U.S. PATENT DOCUMENTS

| | | | | |
|---|---|---|---|---|
| 1,592,244 | A | 9/1923 | Wiggins | |
| 1,674,104 | A * | 6/1928 | Gallagher | 220/219 |
| 1,767,142 | A | 6/1930 | Kramer | |
| 2,321,058 | A * | 6/1943 | Wiggins | 220/219 |
| 2,663,452 | A | 12/1953 | Wiggins | |
| 2,846,109 | A | 8/1958 | Larsen | |
| 3,511,406 | A | 5/1970 | Creith et al. | |
| 3,535,236 | A * | 10/1970 | Travis | 210/136 |
| 3,756,265 | A | 9/1973 | Wagoner et al. | |
| 4,034,887 | A | 7/1977 | Sherlock | |
| 4,134,515 | A * | 1/1979 | Hills et al. | 220/219 |
| 4,248,357 | A | 2/1981 | Stafford | |
| 5,353,941 | A | 10/1994 | Benvegnu et al. | |
| 5,831,198 | A * | 11/1998 | Turley et al. | 89/1.11 |
| 5,899,039 | A * | 5/1999 | Duff et al. | 52/506.06 |

FOREIGN PATENT DOCUMENTS

| | | |
|---|---|---|
| BE | 473 880 | 7/1947 |
| BE | 520 331 | 6/1955 |
| BE | 520 332 | 6/1955 |
| FR | 2 382 381 | 9/1978 |
| JP | 50-043513 | 4/1975 |

OTHER PUBLICATIONS

Dec. 11, 2007 international search report issued in connection with international application No. PCT/US2007/011274.
Dec. 11, 2007 written opinion issued in connection with international application No. PCT/US2007/011274.
Rigid-piped drain systems (described in IDS and illustrated in the figure at the top of p. 2 of IDS).
Central open-drain systems (described in IDS and illustrated in the figure in the lower left of p. 2 of IDS).
Raised open-drain systems (described in IDS and illustrated in the figure in the lower right of p. 2 of IDS).
Reverse-slope open-drain system (described in IDS and illustrated in the figure on p. 3 of IDS).

(Continued)

*Primary Examiner* — Anthony Stashick
*Assistant Examiner* — Elizabeth Volz
(74) *Attorney, Agent, or Firm* — Osha • Liang LLP

(57) ABSTRACT

A storage tank with a full-contact floating roof is provided with automatic drains that have drain openings that are elevated above the top surface of the deck of the roof. Tilting mechanisms are used to tilt the deck toward the drains, causing liquid on the deck surface to pool at the drains, rising to the level of the drain openings. Cables connected to elevated portions of the tank can be used to tilt the deck from above, and landing supports can be used to tilt the deck from below.

24 Claims, 6 Drawing Sheets

OTHER PUBLICATIONS

Written Opinion issued from the Australian Patent Office for related Singaporean Application No. 200807690-3; dated Oct. 7, 2009 (7 pages).

Examination Report issued by the State Intellectual Property Office of the P.R. China in related Application No. GCC/P/2007/8369; Dated May 18, 2010 (5 pages).

* cited by examiner

STORAGE TANK WITH SELF-DRAINING FULL-CONTACT FLOATING ROOF

CROSS-REFERENCE TO RELATED APPLICATIONS

Not applicable.

STATEMENT REGARDING FEDERALLY-SPONSORED RESEARCH OR DEVELOPMENT

Not applicable.

REFERENCE TO A COMPACT DISK APPENDIX

Not applicable.

BACKGROUND OF THE INVENTION

This invention relates generally to large-scale liquid storage tanks, and more particularly to full-contact, floating-roof storage tanks used for storing liquids at atmospheric pressures. Such tanks, which sometimes include a separate, fixed roof, commonly range from 15' to 400' or more in diameter, holding up to 1.5 million barrels of liquid or more.

Vapor control is often an issue. Vapors escaping from stored hydrocarbon-based liquids can present a health, safety, or fire hazard. Vapors escaping from flammable liquids can form an explosive mixture with air. Other liquids, particularly those containing sulfur, have an objectionable odor when allowed to freely evaporate. Consequently, efforts are often made to minimize evaporation losses in storage tanks.

A floating roof is a buoyant structure that floats on the liquid surface, limiting evaporation. An "internal" floating roof is used inside a tank with a separate, fixed roof. An "external" floating roof is used in a tank that has no fixed roof. In addition to reducing evaporation losses, floating roofs also keep weather and airborne contaminants out of the stored product.

There are different types of floating roofs. A vapor-space roof typically has buoyant members that support a deck above the liquid surface. For example, some floating roofs have a relatively thin aluminum deck that is supported by members that float on the surface of the stored product, leaving several inches of vapor space between the surface of the liquid and the deck. The space is useful because aluminum decks are more subject to leaking than welded steel decks. The distance from the top of the roof to the bottom of the buoyant members can be relatively large, on the order of 12 inches or more. One problem with this arrangement is that the stored product often leaks into the floating members, and is difficult to remove without supporting the floating roof from a fixed roof that has been designed for this additional load.

Full-contact floating roofs, on the other hand, leave no space between the deck and the surface of the product. They are designed to float on the surface of the product.

In a typical floating-roof tank, the shell of the tank is cylindrical and the roof floats upon the surface of the liquid product stored in the tank, rising or falling within the tank as liquid product is pumped in or drawn out. To allow space for inlet or outlet piping or internal process structures, and to make it easier to perform maintenance work on either the floor of the tank or the bottom of the floating roof, structure is generally provided to keep the roof suspended off the floor when the tank is completely emptied.

Sometimes this suspending structure takes the form of supports that maintain the roof at a low level. These supports can be fixed or adjustable. Fixed supports provide limited maintenance accessibility and decrease the useable tank volume. Manually-adjustable supports impose less limitation, but generally require personnel to enter a confined, potentially dangerous space to adjust the settings of the supports. They also add more weight to the floating roof and create potential emission pathways.

Supporting a floating roof from a fixed roof or providing remotely-activatable bottom supports would allow the position of a floating roof to be adjustable from the outside. However, the cost of such arrangements has generally been prohibitive on full-contact roofs.

The fact that liquid product sometimes collects on the deck of the floating roof contributes to the high cost. If too much liquid reaches the top of the deck, it can imbalance the roof and cause it to sink. Recovery of a sunken roof can be expensive and time-consuming, and is a safety hazard. The added weight of liquid on the deck must also be factored into design considerations. The roof itself and the supporting structure must be strong enough to withstand the load of trapped liquid when the roof is in a suspended position. (U.S. standards and regulations today require designers to assume a live load of 12.5 psf on the floating roof.) These requirements have generally led to heavy roofs which, in turn, have led those skilled in the art away from idea of trying to suspend a full-contact floating roof from either a fixed roof or from the shell of the tank.

With vapor-space roofs, the problem of liquid on the top of the deck is sometimes solved by providing drain openings in the deck. However, conventional drain openings are not practical on full-contact floating roofs because the top surface of the deck is generally below the surface level of the stored product, and the stored product would tend to flow up through the drains onto the deck.

BRIEF SUMMARY

The applicants have developed a self-draining arrangement that can be used effectively on full-contact floating roofs. The self-draining feature reduces the loads on a floating roof, allowing the use of a thinner and lighter roof. (When a roof is self-draining, U.S. standards and regulations today require designers to assume a live load of only 5 psf.) Lighter weight, in turn, makes it more practical to suspend the floating roof from a fixed roof or from the side of the tank, or to use remotely-activated landing supports, either of which can increase the useable capacity of the storage tank.

As described in more detail below, the new arrangement uses special tilting structure that enables the top surface of the deck to be tilted toward a new form of drain. The drain has an opening that is spaced at a significant distance above the top surface of the deck. This spacing helps to prevent stored product from unintentionally flowing up through the drain onto the top of the deck.

Use of the invention may permit the peripheral rim of some roofs to be as little as 15" or less, and a central portion of the deck to be as little as ⅛" thick or less. These relatively small dimensions and the resulting reduced weight can provide significant advantages, including more volume in the tank available for stored product.

BRIEF DESCRIPTION OF THE DRAWINGS

The invention may be better understood by referring to the accompanying drawings, in which.

DETAILED DESCRIPTION

Figure 1:
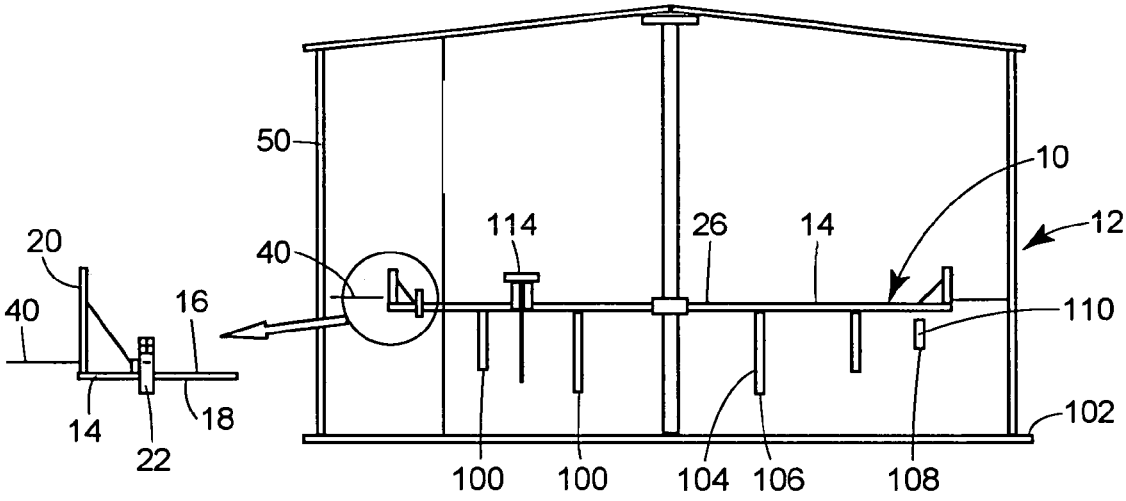
FIG. 1 is an elevational cross-sectional view of a storage tank with a pan roof incorporating the invention.

Examples of storage tanks with the new self-draining floating roof can be seen in the figures. Each illustrated roof 10 is part of a storage tank 12 that can be used for storing liquids at atmospheric pressure. Each illustrated floating roof has a deck 14 with a top surface 16, a bottom surface 18, an outer rim 20, and a plurality of drains 22.

The roof 10 of the tank 12 illustrated in FIG. 1 is a relatively thin pan roof. In conventional pan roofs, the deck central portion is typically around 3/16" thick, and the rim is typically around 15-22" high. The central portion 26 of the illustrated roof is only about 1/8" thick, and the peripheral rim 20 is approximately 12" high. The illustrated roof is made of steel, although similar roofs could be made of other materials, such as aluminum, composite material, or other non-metallic material.

The use of lightweight stainless steel materials may be economical when storing corrosive products. A stainless steel roof offers several advantages over a carbon steel roof. For example, a stainless steel roof should not require the corrosion allowance required for a carbon steel roof. It also should not require underside seal welding or painting. In those cases, it may be possible to install a reduced-thickness stainless steel roof at a cost that is comparable to the cost of a traditional carbon steel roof.

Figure 2:
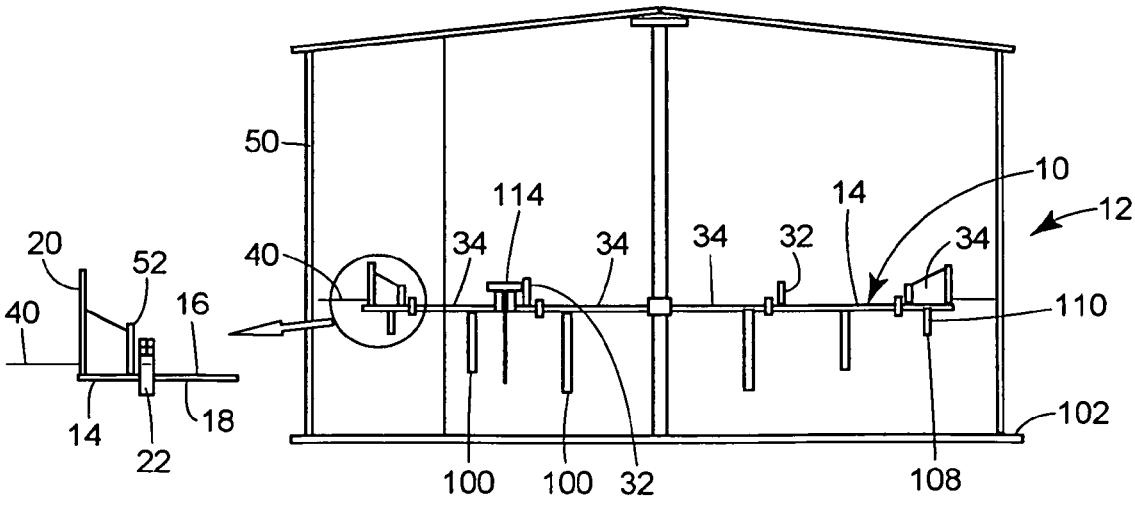
FIG. 2 is an elevational cross-sectional view of a storage tank with a bulkheaded pan roof incorporating the invention.
Figure 3:
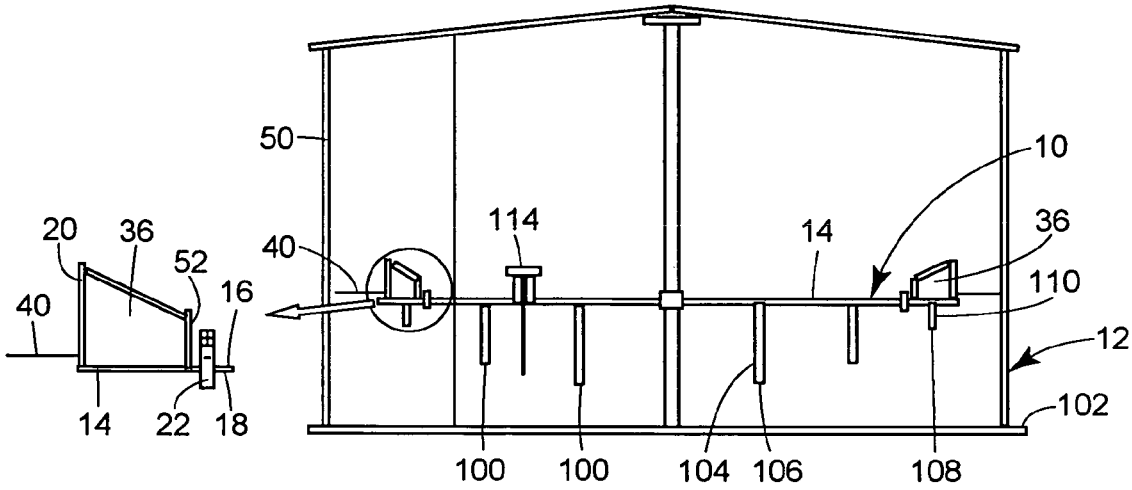
FIG. 3 is an elevational cross-sectional view of a storage tank with a pontoon roof incorporating the invention.
Figure 4:
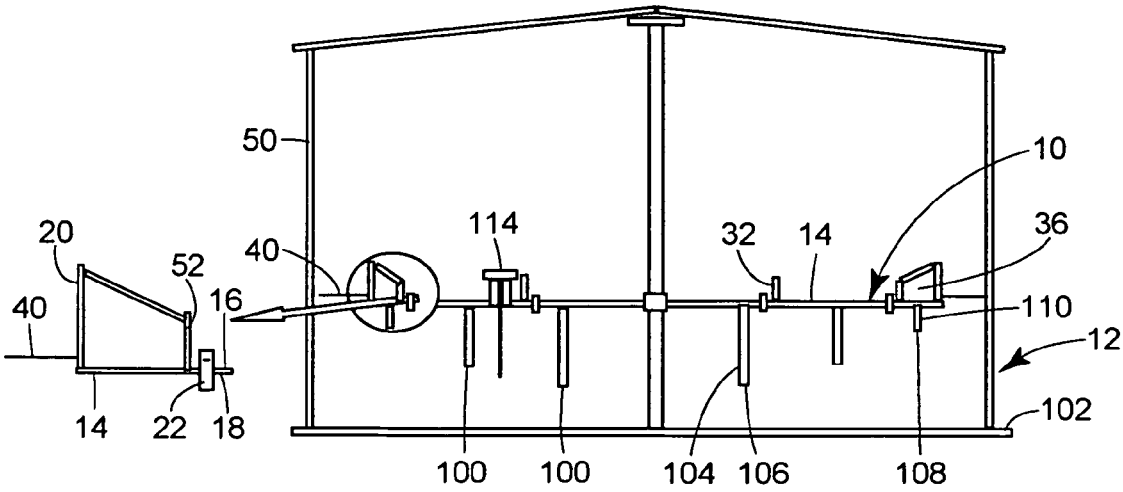
FIG. 4 is an elevational cross-sectional view of a storage tank with a hybrid roof incorporating the invention.

With the invention, other arrangements can also be used for a floating roof. For example, the roof 10 of the tank illustrated in FIG. 2 is a bulkheaded pan roof. Deck rim partitions 32 divide the top of the roof, confining any liquid that may get on the top of the deck 14 to individual open-topped compartments 34. The roof 10 of the tank illustrated in FIG. 3 is a pontoon roof. A closed pontoon 36 surrounds the roof. The illustrated pontoons are approximately 21" high and approximately 7 feet wide. Deck rim partitions 32 and a pontoon 36 can also be used together in a hybrid roof, as seen in FIG. 4. The sizes and dimensions of the various parts of the roof can vary as needed. In these examples, the top surface 16 of the deck is below the surface 40 of the product stored in the tank.

The rim on a conventional pan roof on a 150'-diameter tank may be 21" or higher. A floating roof 10 using the new design that is made of stainless steel with a thickness in the range of 0.105" to 0.135" would allow the height of the rim 20 to be lowered to 18" or less for a 150'-diameter tank. With a pontoon roof, 18" may be viewed as a minimum height needed to allow access for internal welding and inspection of the pontoon 34. In other cases, the rim height could be even further lowered, reducing the roof weight even further and adding even more effective capacity to the tank.

Figure 5:
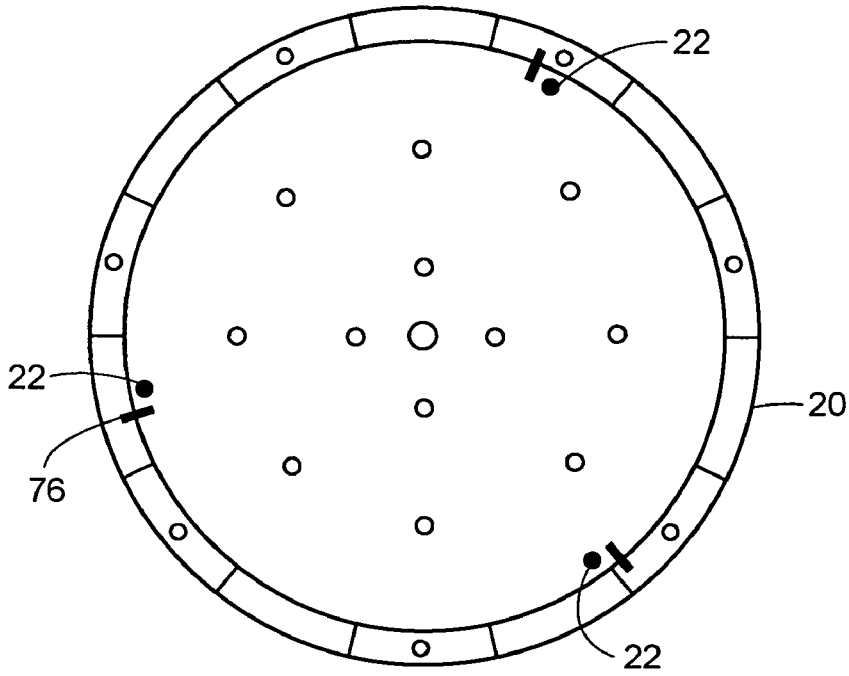
FIG. 5 is a plan view of the pan roof in FIG. 1.
Figure 6:
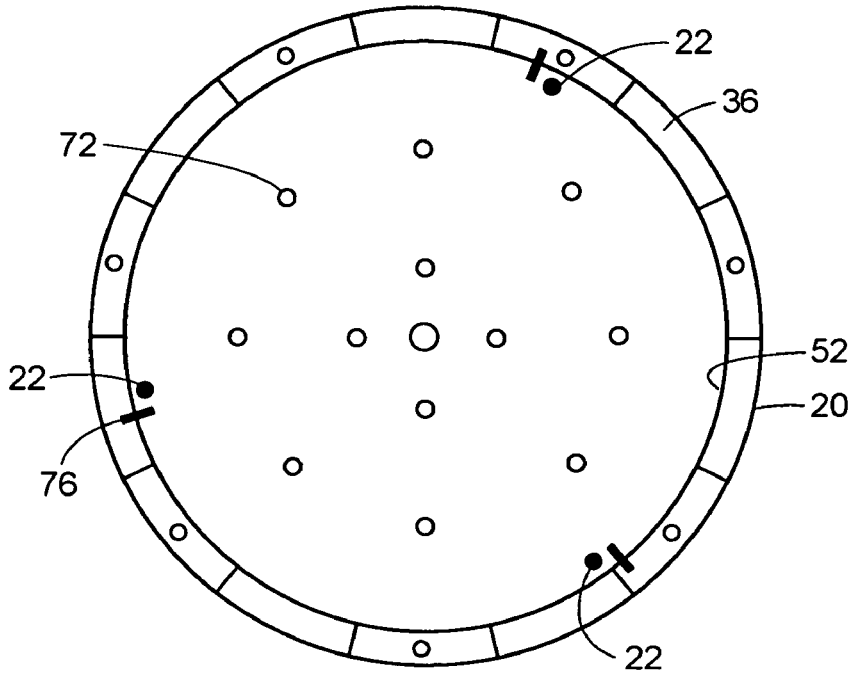
FIG. 6 is a plan view of the pontoon roof in FIG. 3.

The roofs 10 illustrated in the figures move vertically within a shell wall 50 of the tank 12, floating upon the surface 40 of the product stored in the tank. As seen in FIGS. 5 and 6, the drains 22 are spaced about the roof. Preferably, the drains are provided in at least three locations. As will be clearer from the discussion below, this helps to assure draining even if the roof is not perfectly level. The illustrated drains are located near the rim 20. On the pontoon roof 10 seen in FIGS. 3 and 6, the drains are located near the inner rim 52 of the pontoon 36. Arrangements other than those illustrated can also be used.

Figure 7:
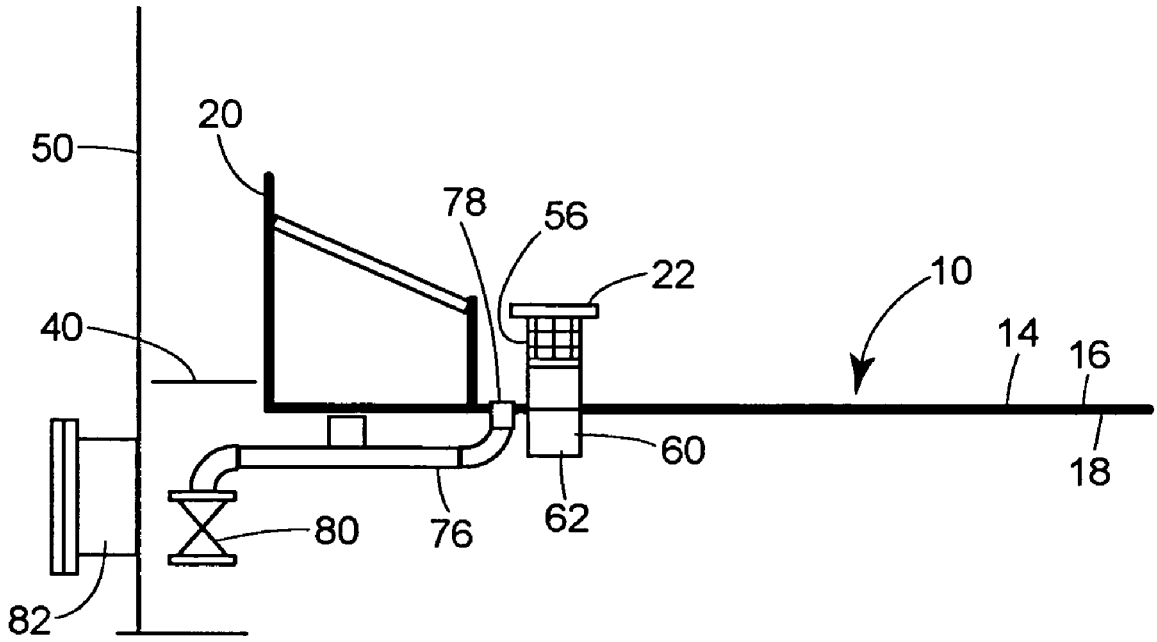
FIG. 7 is an enlarged, cross-sectional elevational view of one of the drains on the pontoon roof of FIG. 3.

As best seen in FIG. 7, the illustrated drains 22 are automatic drains that have a drain opening 56 that is spaced at a significant distance above the top surface 16 of the deck 14. In the example seen in FIG. 7, the drain opening is about 3 inches in diameter and is positioned approximately 5" above the bottom surface 18 of the deck and approximately 3 inches above the surface 40 of the product stored in the tank when the roof is level. This spacing is significant because it is high enough to provide a relatively low likelihood of product in the tank leaking up through the drain onto the deck. This spacing is also low enough that it can provide good draining when the roof tilts, as described below. When determining the height of the drain opening, it may be useful to assume that the product to be stored in the tank has a specific gravity of 0.7. This may provide flexibility for storage of a wide range of products.

The illustrated drains 22 each have a conduit 60 that projects through the roof 10. The illustrated conduit is about 3 inches in diameter, and has a bottom opening 62 that is located several inches below the bottom surface 18 of the deck. Other arrangements could be used. An emission control device such as a flap valve or a ball float can be used with the drain to limit gas emissions through the conduit while allowing liquids from above to drain.

Liquid can be drained from the illustrated roof 10 by tilting the deck 14 toward the drains 22. The slope of the tilted deck causes the liquid to pool toward the drains. Once the level of the pooled liquid reaches the level of the drain opening 56, the liquid begins to drain through the conduit 60.

Figure 8:
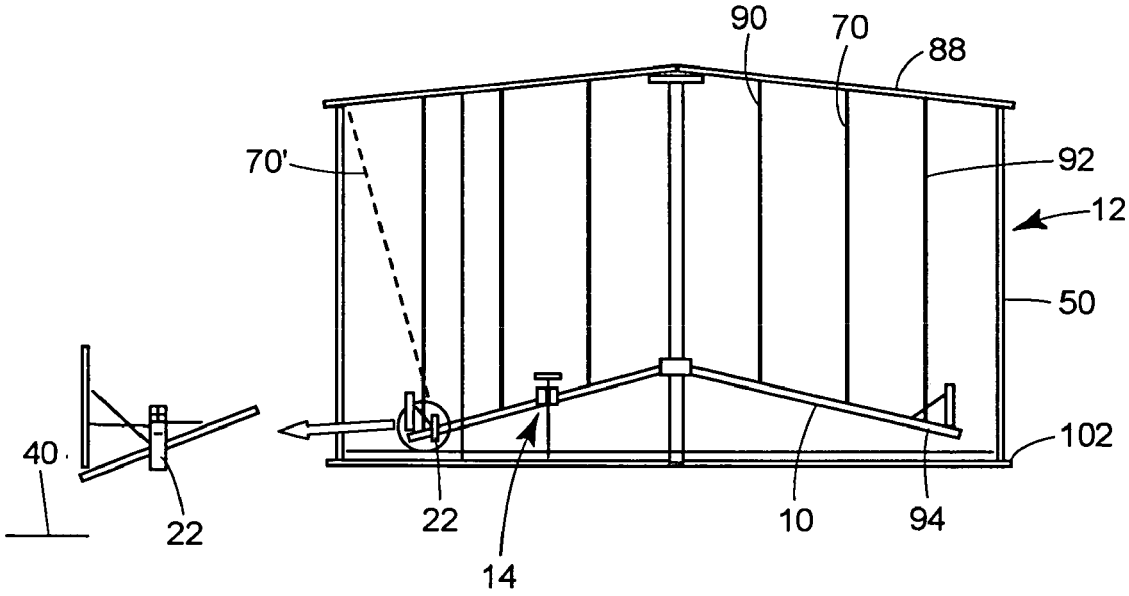
FIG. 8 is an elevational cross-sectional view of a storage tank with a pan roof suspended in a low position.
Figure 9:
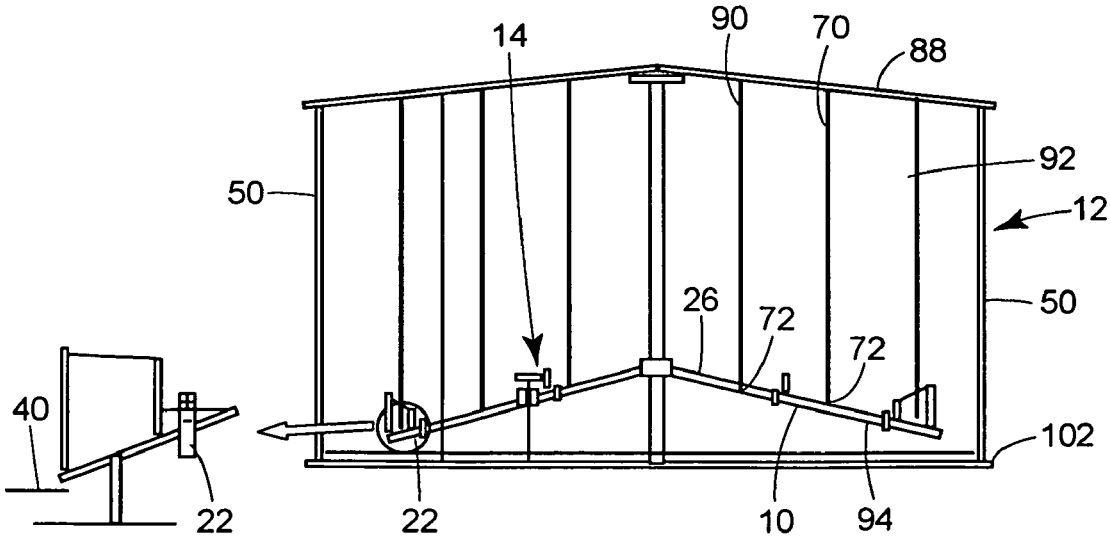
FIG. 9 is an elevational cross-sectional view of a storage tank with a bulkheaded roof suspended in a low position.

A variety of different kinds of structure can be used to tilt the roof 10. In the examples seen in FIGS. 8 and 9, the roof is arranged so that the deck 14 tilts conically toward the drains 22. This can be done by cables or landing supports.

In these examples, cables 70 are used to help tilt the deck 14. This arrangement relies on the ability of the deck to strain under load. The cables are connected so that their lower-most ends 72 have different lower-most elevations within the tank. As the level of the product nears the bottom, the cables attached to the central portion 26 of the deck reach their lowermost elevation, holding the central portion at that position. Meanwhile, the periphery of the deck can continue to lower, causing the deck to begin to slope to the outside, in a conical shape seen in FIGS. 8 and 9 (exaggerated in the drawings).

The cables 70 can be attached, for example, to an overhead fixed roof 88 or to various parts of the shell wall 50. In these examples, the cables 90 that are connected to central portion 26 of the roof 10 are arranged so that the lowermost elevations of their lowermost ends 72 are higher than the lowermost elevations of the lowermost ends of the outer cables 92 connected to peripheral parts 94 of the roof. The length of some cables can also be varied, or their upper attachment points can be moved laterally so that some of the cables extend at an angle, depicted by 70', shortening the effective vertical length of those angled cables.

Supporting the floating roof 10 from the shell wall 50 or from a fixed roof 88 can provide another benefit. In the event the roof becomes imbalanced and starts to sink, the connection of the cables 70 to suspension points near the sinking side of the rim 20 may tend to level the roof, reducing damage from the incident and restoration costs.

Stainless steel aircraft cable may be a good choice for the cables 70 because it coils easily. Multi-strand coated steel cable may also be used. If self-coiling cables are used, the cables may self-coil when the roof rises. This reduces the chance of problems arising from slack cables, without the need for winches or reels.

The number of cables 70 depends on the strength of the floating roof 10 and of the shell wall 50 or the fixed roof 88 where the cables are attached. Supports for conventional floating-roof tanks are often spaced 18'-20' apart to keep roof stresses at acceptable levels for the dead load plus an assumed 12.5 psf live load. Similar or even more distant spacing may be sufficient using the new design, since the assumed live load can be as low as 5 psf.

The illustrated deck 14 can also be tilted by using landing supports 100 such as the ones seen in FIGS. 1-4. These supports extend downwardly from the roof and engage the floor 102 when product is drained from the tank 12. A conical tilt can be achieved by using central supports 104 whose lowermost ends 106 are further below the roof (or can be extended further below the roof) than the lowermost ends 108 of the peripheral supports 110, providing a longer effective length.

Figure 10:
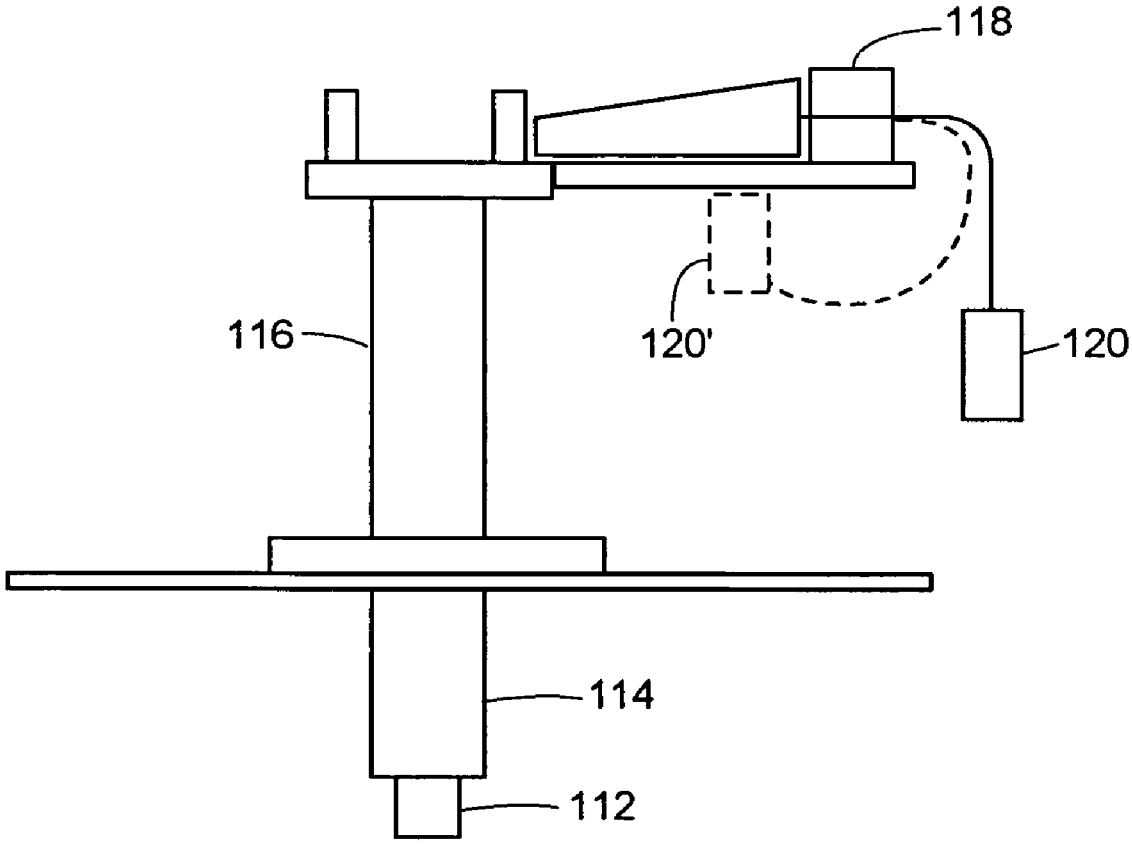
FIG. 10 is a detailed view of a possible landing support for the roof.

The landing supports 100 can be remotely activated so that they do not extend into the stored product except during emptying operations. The supports seen in FIG. 10 include a support leg 112 that extends through a sleeve 114. The illustrated activator 116 includes a remotely-activated pusher 118 and a weight 120 that can be moved to a storage position 120' during maintenance. The illustrated weight automatically unlocks the activator when the roof begins to rise. The activator can operate in a variety of ways. It can, for example, be based on a cable release of a spring or pressure cylinder, by pressure applied to a tubing manifold, or by electronic activation. The supports can be arranged to provide for both a low operation position, a higher maintenance position, and (if desired) an even higher position for easier access for painting, etc. inside the tank.

As seen in FIG. 7, a manual flush drain 76 can be used to drain more liquid from the roof 10. The illustrated flush drain has an opening 78 that is relatively flush with the top surface 16 of the deck 14, which permits the manual drain to be used to drain liquids that do not reach the automatic drain opening 56 even when the deck is tilted. This manual drain can be sealed by a valve 80 to prevent stored liquid from traveling up through the manual drain to the top of the deck during normal use. In some cases, a blind flange or cap can also be used. The illustrated valve can be accessed from underneath the roof through a manhole 82. The manual drain may be installed in a small sump to avoid product exposure.

As with other floating roofs, a breather vent 114 (FIGS. 8 and 9) on the roof 10 can be set to open when the roof hits the landing position. This can help to assure that vacuum issues that can otherwise arise when the liquid level falls below the roof are no more of a problem than with conventional floating roofs. A larger-than-normal breather vent may be used to avoid vacuum loads greater than 5 psf.

Supporting the roof in these ways can reduce the need for providing access to the top of the floating roof. This, in turn, can eliminate the need for vertical ladders on the inside wall of the tank. Eliminating ladders lowers emission possibilities.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A liquid storage tank that has a shell wall and a full-contact floating roof that has a single deck with a top surface and is designed to move vertically within the wall, floating upon the surface of product stored in the tank, the tank having:

at least one gravity drain on the roof with an opening spaced at a significant distance above the top surface of the single deck; and a structure that enables the top surface of the single deck to be tilted toward the gravity drain opening.

2. A storage tank as recited in claim 1, in which the roof is a pan roof with a peripheral rim.

3. A storage tank as recited in claim 1, in which the roof is a bulkheaded roof with a peripheral open-top bulkhead compartment and a central open-top bulkhead compartment.

4. A storage tank as recited in claim 1, in which the roof is a pontoon roof with a peripheral pontoon.

5. A storage tank as recited in claim 1, in which the roof is a hybrid roof with a peripheral pontoon and a central open-top compartment.

6. A storage tank as recited in claim 1, in which a central portion of the roof is no more than 2 inches thick.

7. A storage tank as recited in claim 1, in which a central portion of the roof is no less than 1/32 inch thick.

8. A storage tank as recited in claim 1, in which the roof is made primarily of steel and the height of a peripheral rim on the roof is no more than about 30".

9. A storage tank as recited in claim 1, in which the structure enables the deck to tilt on a plane.

10. A storage tank as recited in claim 1, in which the structure enables the deck to tilt conically.

11. A storage tank as recited in claim 1, in which the structure includes cables connecting different parts of the roof to elevated portions of the tank.

12. A storage tank as recited in claim 1, in which the structure includes cables connecting different parts of the roof to an overhead fixed roof.

13. A storage tank as recited in claim 1, in which the structure includes cables attached to different sections of the roof at different elevations.

14. A storage tank as recited in claim 1, in which the structure includes self-coiling cables.

15. A storage tank as recited in claim 1, in which the structure includes supports that extend from different parts of the bottom of the roof.

16. A storage tank as recited in claim 1, in which the structure includes supports that extend from different parts of the bottom of the roof, different supports having different effective lengths.

17. A storage tank as recited in claim 1, in which the structure includes supports that can be activated remotely to extend from different parts of the bottom of the roof.

18. A storage tank as recited in claim 1, in which the structure includes supports that can be activated remotely to extend at different effective lengths from different parts of the bottom of the roof.

19. A storage tank as recited in claim 1, in which the gravity drain opening is an automatic drain opening that is spaced from 2" to 8" above the top surface of the deck.

20. A storage tank as recited in claim 1, in which the gravity drain opening is an automatic drain opening that is spaced from 3" to 9" above the bottom surface of the deck.

21. A storage tank as recited in claim 1, in which the gravity drain opening is an automatic drain opening that is disposed near a peripheral rim of the roof.

22. A storage tank as recited in claim 1 that has a plurality of gravity drain openings spaced about the roof.

23. A storage tank as recited in claim 1 in which the gravity drain opening is an automatic drain opening and the tank also has at least one manual drain opening.

24. A storage tank as recited in claim 1 that also has a manual drain opening disposed near an outer rim.

* * * * *